US008322645B2

(12) United States Patent
De Snoeck et al.

(10) Patent No.: US 8,322,645 B2
(45) Date of Patent: Dec. 4, 2012

(54) MACHINE AND WINDING PROCESS FOR THE STORAGE OF FLAT ELEMENTS

(75) Inventors: Franck De Snoeck, Saint Saulve (FR); Yazid Boussellaoui, Tourcoing (FR); Emmanuel Druon, Tournai (BE)

(73) Assignee: Pocheco, Forest-sur-Marque (FR)

( * ) Notice: Subject to any disclaimer, the term of this patent is extended or adjusted under 35 U.S.C. 154(b) by 377 days.

(21) Appl. No.: 11/517,682

(22) Filed: Sep. 8, 2006

(65) Prior Publication Data

US 2007/0051844 A1 Mar. 8, 2007

(30) Foreign Application Priority Data

Sep. 8, 2005 (FR) ..... 05 09170

(51) Int. Cl.
*B65H 39/14* (2006.01)

(52) U.S. Cl. ..... 242/528

(58) Field of Classification Search ..... 242/528, 242/421, 421.5, 421.6, 421.7, 422, 422.3, 242/534.1, 538, 538.1, 534; 53/399, 430, 53/117, 118, 587; 100/29, 32
See application file for complete search history.

(56) References Cited

U.S. PATENT DOCUMENTS

| | | | | |
|---|---|---|---|---|
| 3,912,193 | A * | 10/1975 | Calvaer | 242/534.1 |
| 4,538,397 | A | 9/1985 | Boss | |
| 4,651,941 | A | 3/1987 | Muller | |
| 5,116,043 | A * | 5/1992 | Jermann et al. | 271/213 |
| 5,626,001 | A * | 5/1997 | Belec | 53/284.3 |
| 5,673,869 | A * | 10/1997 | Honegger | 242/528 |

FOREIGN PATENT DOCUMENTS

| | | |
|---|---|---|
| EP | 0826616 | 3/1998 |
| JP | 10059594 | 3/1998 |

* cited by examiner

*Primary Examiner* — William E Dondero
(74) *Attorney, Agent, or Firm* — Ladas & Parry LLP

(57) ABSTRACT

A machine and a winding process receiving a continuous flow of flat and flexible elements (10) aligned along a longitudinal axis and partially overlapping, to form a spool (6) by rolling these elements into a spiral around a drum (8), with insertion between the turns of a flexible central strip (26), one end of which is fixed onto the drum and the other end of which unwinds from a hub (60) on which the strip has previously been wound, characterized in that the machine also includes a motor-driven resource (54) to regulate the transverse position of the hub (60) so as to perform lateral movement in relation to the spool (6) in order to maintain a constant alignment of the strip (26) during the winding process.

24 Claims, 2 Drawing Sheets

MACHINE AND WINDING PROCESS FOR THE STORAGE OF FLAT ELEMENTS

This present invention concerns a machine and a winding process for flat and flexible elements arriving continuously and partially overlapping, such as printed sheets or envelopes, to store them and transport them in anticipation of an unwinding operation by another appliance that is using these elements.

The storage spools include a central drum with a hub that is inserted into the winding machine and a cylindrical outer peripheral part on which is wound, in a spiral, a continuous flow of flat elements aligned along the longitudinal axis of motion and partially overlapping. A flexible strip fixed by one end to a median point of the drum is wound at the same time as the flat elements, so as to create a separation between the different winding layers and to clamp them onto the drum in order to maintain the assembly in position. The flat elements generally come from a continuous printing machine, and are spooled in order to be stored as they leave this machine.

The spools are then delivered to the next plant section, which, for example, makes up periodicals by assembling different sheets coming from several spools, or automatically envelopes documents by inserting them into envelopes, also coming from a spool. To this end, the spool is unwound to extract the flat elements. The strip unwinds simultaneously and is stored temporarily on a hub. Once the spool has been emptied, the strip is returned to the drum by being wound onto it, and then the assembly is returned to the plant from which it came for reuse.

One of the main drawbacks of this system is that for the drums coming back from the plants of different customers, the strip may have been wound very unevenly, and after much manhandling for transportation purposes during which the spool can undergo many impacts, the flexible strip has shifted to varying degrees in relation to the transverse median plane of the drum.

During the next winding process, since the flexible strip is not perfectly centred over all of its length in relation to the flat elements, the spool is then deformed.

In effect, since the spool is composed of a stacking of flexible elements and the strip used to clamp it covers only a central part of the flat element, the unclamped lateral parts are deformed. If the strip shifts laterally during the winding process, the deformation of the flat elements is irregular, and this can then result in problems for the automatic machines located downstream which then cannot grip the elements.

In addition, the geometry of the spool is also incorrect in this case, with lateral faces that are deformed, and no longer flat. This problem, especially in the case where it coincides with a poorly regulated strip tension during the winding process, can lead to an axial shifting of the drum or part of the spool during handling, possibly resulting in the complete collapse of the spool.

This present invention in particular has as its objective to avoid these drawbacks, and to bring to the implementation of a winding machine a solution that is simple and effective, providing a guarantee of good running quality of the spools.

To this end, it proposes a winding machine that includes firstly a winding assembly receiving a continuous flow of flat and flexible elements aligned along a longitudinal axis and partially overlapping, to form a spool by winding these elements in a spiral around a drum, with insertion between the turns of a flexible central strip, one extremity of which is fixed onto the drum, and secondly an assembly for unwinding the said flexible strip, the other extremity of which unwinds from a hub on which the strip has previously been wound, with a braking device being provided on the hub to ensure continuous tension of the strip. In a characteristic manner, the machine also includes a motor-driven resource for regulating the transverse position of the hub so as to perform lateral movements in relation to the spool in order to maintain a constant alignment of the strip during the winding process.

One essential advantage of the winding machine according to the invention is that since the transverse position of the strip is rigorously guaranteed by the motor-driven resource, the wound strip is aligned correctly on a given plane and on the axis of the flat elements, thus ensuring that these elements undergo a uniform deformation and that the spool remains symmetrical.

In addition, since the regulating resource is motor-driven, it can be very responsive and ensure a good position of the start of the winding for all types of winding faults observed on drums returning empty with their strip wound on.

According to a preferred method of implementation of the invention, the hub is fixed onto a shaft supported by a trolley mounted on a guidance resource allowing a transverse movement in relation to a chassis of the unwinding assembly.

Preferably, the motor-driven resource is an electrical actuator that includes a ball screw and a nut, connected firstly to the chassis and secondly to the trolley, effecting a transverse positioning of one in relation to the other.

Advantageously, the motor-driven resource for regulating the transverse position of the hub in relation to the spool, in order to control its movement during the winding process, uses a sensor that is fixed in relation to a chassis of the unwinding assembly, providing data on the lateral position of the strip in a location situated close to the unwinding point of the strip from the hub.

Preferably, the motor-driven resource for regulating the transverse position of the hub is used to align the strip laterally on the hub during a prior operation for winding the strip onto the hub from the drum.

The lateral alignment of the strip in relation to the hub during the prior operation for winding onto this hub can use a sensor that is fixed in relation to the trolley, providing data on the lateral position of the strip in a location situated close to of the point of winding the strip onto the hub.

The sensor providing data on the lateral position of the strip can be an optical sensor.

According to a preferred method of implementation, the braking device includes a rotating electrical machine controlled by a command to apply a braking force or a motor torque.

The belt drive of the conveyor feeding the stream of flat elements can take the form of a tangential contact of this belt onto the external periphery of the spool, and a sensor can provide information on the movement of the belt and on the direction of this movement, in order to control the electrical machine and apply either a braking force if the winder is in the process of winding, or a motor torque if the winder is rotating in the other direction for the prior winding operation of the strip onto the hub.

Preferably, the traction on the strip created by the braking force applied by the electrical machine falls off regularly during a winding operation.

The decrease in the traction on the strip during a winding operation can be controlled by a sensor providing data on the external diameter of the spool during the winding process.

In one method of implementation, the decrease in the traction on the strip between the start and the end of the winding process falls within a range of between two and four.

According to one interesting use of the invention, the flat elements wound onto the spool are envelopes. These can have a width that is greater than the height, and be positioned transversally in relation to the flow along the width.

In particular, the spooled envelopes have a width of about 19 to 24 centimetres and a height of about 11 to 18centimetres, and the tension of the strip is of the order of 300 Newtons at the start of the winding and 100 Newton at the end.

Advantageously, the completed spools of envelopes are used downstream by an automatic enveloping machine which unwinds these spools, extracting the envelopes one by one, and automatically inserts postal material into them.

According to another aspect, the invention also refers to a winding process for a spool from a continuous flow of flat and flexible elements which are aligned along a longitudinal axis and partially overlap.

The winding is achieved by rolling these flat elements in a spiral around a drum, with insertion between the turns of a flexible central strip which is unwound from a hub.

In characteristic fashion, during the unwinding process, the lateral position of the flexible central strip wound around the said drum (8) is monitored continuously, in order to modify the transverse position of the hub according to the result of this monitoring.

Preferably, this monitoring of the lateral position of the flexible central strip is effected by monitoring resources, possibly optical, linked to a motor-driven resource, possibly of the motor-driven actuator type, so as to regulate the transverse position of the hub.

Again preferably, the monitoring of the lateral position of the flexible central strip determines the offset between this lateral position of the flexible central strip and the axis of the drum.

The transverse position of the hub is then modified in order to remove this offset.

Where appropriate, prior to the winding of the flat elements in a spiral around the drum, with insertion between the turns of the flexible central strip, the latter is drawn from a drum and wound around the hub.

In this case, during the winding of the flexible central strip around the hub, continuous monitoring is performed on the lateral position of this flexible central strip wound around the said hub, and the transverse position of this hub is modified according to the result of this monitoring.

Preferably, monitoring of the lateral position of the flexible central strip wound around the hub is effected by monitoring resources, of the optical type for example, linked to a motor-driven resource of the motor-driven actuator type for example, in order to regulate the transverse position of the hub.

Again preferably, monitoring of the lateral position of the flexible central strip wound around the hub determines the offset between this lateral position of the flexible central strip and the axis of the hub.

The transverse position of the hub is then modified in order to remove this offset.

Where appropriate, during the winding of the flat elements in a spiral around the drum, continuous adjustment is maintained of the tension setting of the flexible central strip on the formation of each turn.

Preferably, the adjustment of this tension of the flexible central strip is achieved by adjusting the unwinding speed of this flexible central strip from the hub.

Again preferably, the unwinding speed of the flexible central strip from the hub reduces, possibly linearly, as the diameter of the spool increases.

The decrease in the unwinding speed of the flexible central strip from the hub can be achieved by a braking device provided on this hub (60) and linked to a monitoring resource, preferably of the ultrasound sensor type, at the axis of the spool.

The invention will be understood better, and other characteristics and advantages will appear more clearly, on reading the following description, which is provided by way of an example only, with reference to the attached drawings in which.

Figure 1:
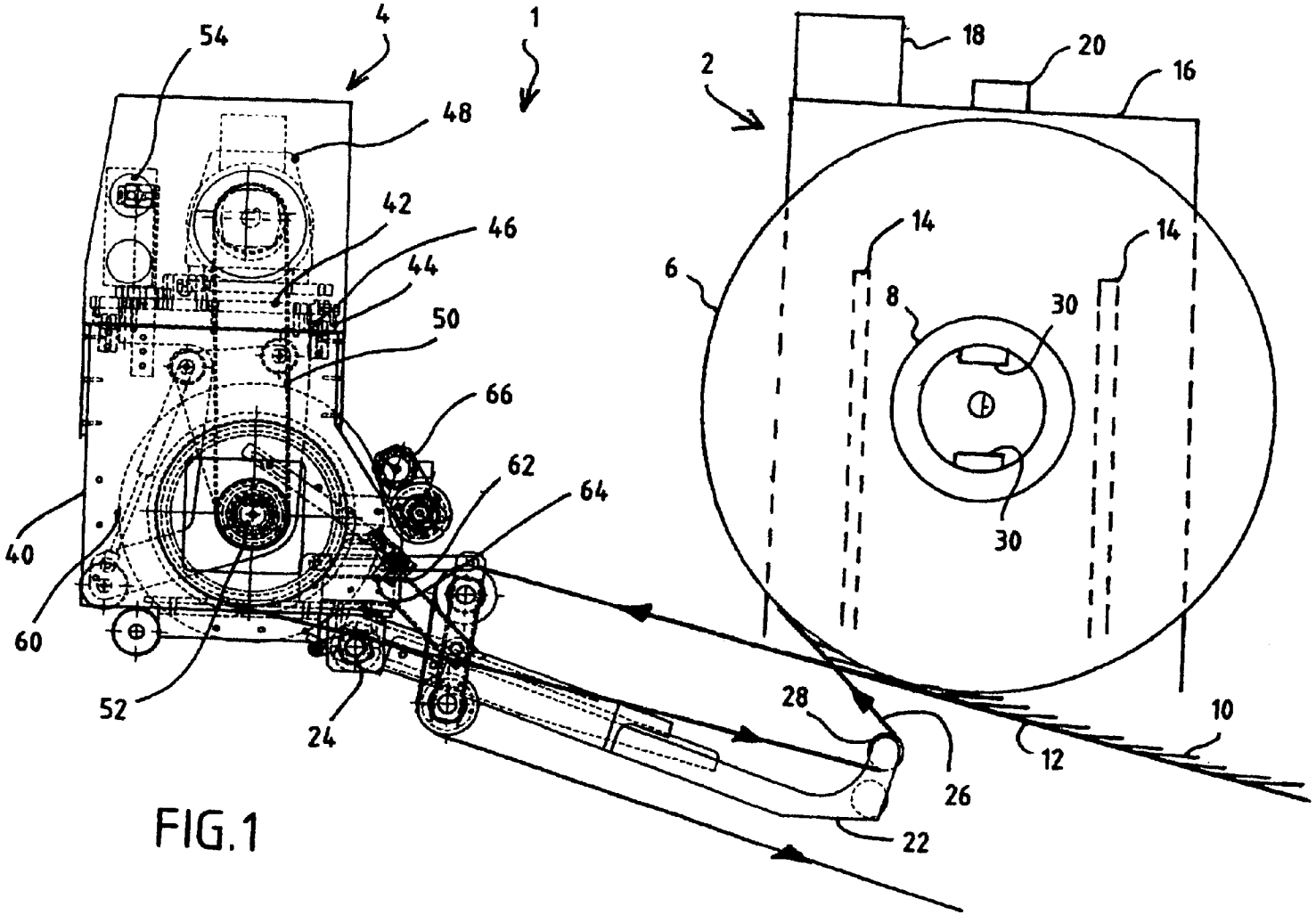
FIG. 1 represents a front view of a winding machine according to the invention.

FIG. 1 represents a winding machine 1 that includes a winding assembly or winder 2 of flat and flexible elements 10 and an assembly 4 for unwinding a flexible strip 26. The flat elements 10 emerge from a production machine which, for example, from a continuous strip of printed paper, cuts out, folds, applies gum to and assembles elements such as envelopes. The spool 6 includes, at its centre, a drum 8 onto which are spooled the flat elements 10, where the hub of the drum is maintained by a clamp system 30 allowing rapid mounting onto a rotating axis supported by the chassis 16 of the assembly 2, and is driven in rotation by a winding motor.

One end of a flexible strip 26 is fixed onto the drum 8 so that it can be wound onto the latter in a transverse plane that is approximately centred on the middle of the drum.

The elements 10 arrive aligned along the axis of the flow, overlapping each other, on a conveyor 12 composed of two parallel belts placed on either side of the longitudinal axis. The conveyor 12 has no motor drive of its own, and the belts make continuous tangential contact with the external periphery of the spool 6 and are driven by this contact, enabling perfect synchronisation to be maintained between the forward speed of the conveyor 12 and the peripheral speed of the spool 6, with no rubbing. The state and the position of the flat elements 10 is thus guaranteed.

Close to the tangential contact point with the spool 6, the flexible strip 26, drawn by the spool and held in tension by the unwinding assembly 4, including a brake, is inserted between the two belts of the conveyor 12 in order to flatten the flow of flat elements 10 onto the periphery of the spool. These elements are then rolled in a spiral, each turn being separated from the next by the strip 26 which keeps everything tight in a continuous fashion.

The axis of the drum 8 of the spool 6 is fixed to the chassis 16 of the winding assembly 2 by guide rails 14 so as to be able to slide vertically under the action of a motor 18. The flexible strip 26 coming from the unwinding assembly 4 passes behind a roller 28 mounted to rotate freely at the end of an arm 22 pivoting around an axis 24. The roller 28 is used to regulate the tension of the strip 26, and it also allows monitoring of the increase in the diameter of the spool 6, with a sensor measuring the deflection of the arm during the winding on of the flat elements 10, and after a certain amount of movement, controls the raising of the axis of rotation of the spool 6 by a predetermined incremental amount.

Figure 2:
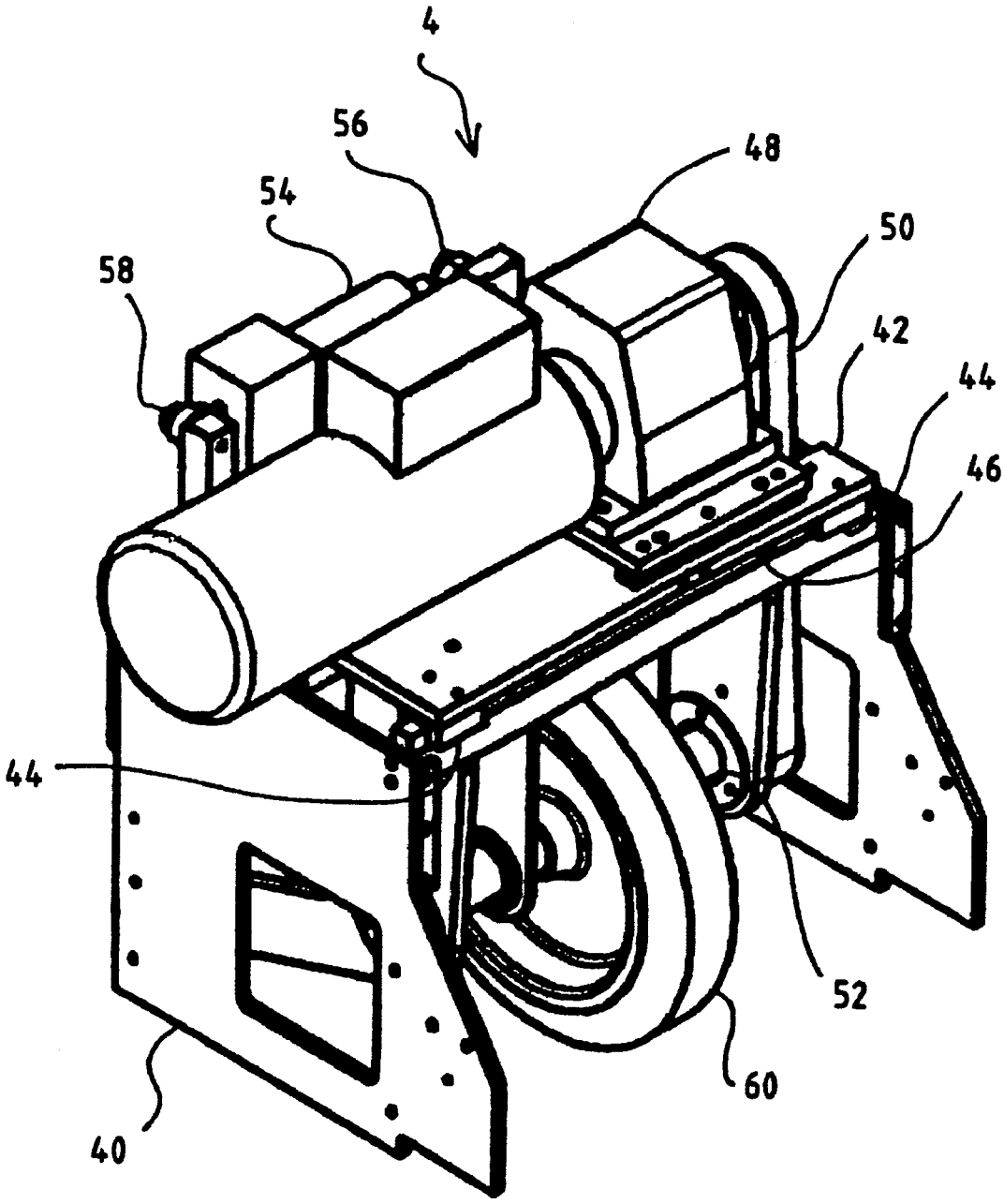
FIG. 2 represents a view in perspective of part of the winding machine that includes the device for unwinding from a hub.

FIG. 2 presents the unwinding assembly 4, which includes a chassis 40 that is fixed in relation to the winding assembly 2, having on its upper part a trolley 42 which is mobile transversally. On its lower face, the trolley 42 includes two sets of two spaced guide pieces 44, with each set sliding on a rail 46 connected to the chassis 40 so as to ensure accurate guidance.

A geared motor 48 is fixed onto the top of the trolley 42, and a pulley wheel located at its end receives a toothed belt 50 which drives a second pulley wheel fixed onto a shaft 52 supported by two bearings set into the chassis 40. A hub 60 placed between the bearings is supported by the shaft 52. This includes, on its periphery, a succession of magnetised studs receiving a metal part fixed to the extremity of the flexible strip 26 in order to start the winding-on process.

In addition, the lateral position of the trolley 42 is controlled by an electrical actuator 54 composed of a screw that is driven by an electric motor which causes a nut to slide axially by means of balls that ensure operation with neither play nor rubbing. This actuator 54 firstly bears onto a support 56 connected to the trolley 42 and secondly onto a support 58 connected to the chassis 40. This is used to adjust the lateral position of the trolley and therefore of the hub 60, quickly and accurately.

This adjustment is based on the signal provided by two optical sensors 62, 64 and a coder wheel 66. The optical sensors are fixed, one 62 to the trolley 42 and the other 64 to the chassis 40, close to the winding point of the strip 26 onto the hub 60, and provide a signal according to the lateral position of the strip 26. The coder wheel 66 is driven in rotation by the belt 12, and provides a signal indicating the rotation of the spool as well as the direction of rotation.

The operation of the winding machine is as follows. While a spool is in the process of winding onto a first winding assembly, a second spool 6 placed on a second winding assembly is prepared to take over from it. A drum 8 that includes a strip 26 wound onto it is fixed by clamps 30 to the axis of the winder. The free end of the strip is guided to the hub 60 by a belt (not shown), and then fixed to the hub by the magnets mounted on it. The geared motor 48 then rolls the strip onto the hub 60 while the sensor 62 fixed to the trolley 42 is used to control the actuator 54 by means of a command, and to move the trolley 44 laterally so as to compensate for the alignment deficiencies of the strip 26 wound on the drum 8, by continuously aligning the hub 60 according to the lateral position of the strip.

Preferably, the sensor 62 is an optical sensor, free of contact and free of wear, which sends a light beam perpendicularly to the strip and astride of one of the edges. By the level of light intensity passing on the side of the strip, it is possible to deduce the lateral offset of its position.

With the strip 28 fully positioned on the hub 60, this winder 2 is ready to start what happens automatically when the other spool is full, with the steering system automatically leading the flow of flat elements 10 to this new spool 6. The drum 8 is caused to rotate, driving the conveyor 12, and this movement, with its direction of motion, is recorded by the coder wheel 66, which in turn sets off the geared motor 48, then acting as an electric generator producing a braking force that affects the tension of the strip 26. By adjusting the electrical power produced, the control of this geared motor 48 is used to simply adjust the braking in a precise and constant manner over time, which is difficult to achieve with mechanical braking that includes rubbing elements which are heating and wearing as they vary the friction coefficient.

For the winding process, the lateral guidance of the trolley 42 is again brought into play using the signal from the sensor 64 fixed to the chassis 40 in order to control the actuator 54 so as to continuously align the strip 26 leaving the hub 60 in relation to the axis of the drum 8 which itself is fixed laterally in relation to the chassis.

By this process of motor-driven lateral adjustment performed successively during the winding of the strip 26 onto the hub 60, and then of winding on the flat elements 10, tests have shown that whatever the state of the winding of the strip 26 onto the drum 8, even in the case where the strip oscillates laterally over the full width of this drum, two successive adjustments of the alignment provide a perfect alignment from the start-up of the spool and a regular deformation of the spooled flat elements 10, while, by means of a purely static device that includes curved tension rollers or lateral guide rollers for example, it is necessary to effect successively several unwindings of the strip to the hub and then winding onto the empty drum in order to be able to progressively restore the alignment.

This is particularly important for flat elements 10 of small width and low height, for envelopes of the business type for example, with a format of about 19 to 24 centimetres in width by 11 to 18 centimetres in height, and positioned transversally in relation to the flow along the width, since the retention by the strip, being applied to a small height, does not provide a high degree of stability of the product. These envelopes are also difficult to spool since the folding of the edges for gumming or the transparent window for the reading of an address result in thickness variations. The spools, which usually take a 300 metre length of strip, having a final diameter of the order of 1.40 metres, representing about 6 times the width, are very sensitive to alignment deficiencies of the strip which, by asymmetrical application of the clamping force, lead to a warping of the flat surfaces and a risk of axial offset of the turns, or even a collapse of the spool.

In addition, excessively large deformations of the spool or of the envelopes can give rise to problems in grasping of the flat elements by the machine using them downstream and resulting in a lot of scrap.

The adjustment of the strip tension is also an important factor of the winding quality, together with the positioning of the strip. Tests have shown that in order to obtain good stability of the spool, and minimal deformation of the flat elements, it is advantageous to begin the winding with a higher tension and then to reduce it progressively. In particular, a linear reduction of the tension in accordance with the increase in the diameter of the spool, gives a good result. As an example, in the case of the spooling of envelopes mentioned previously, the best results are achieved with tensions of the order of 300 Newtons at the start, and 100 Newtons at the end.

In order to achieve this adjustment, it is advantageous to use an ultrasound sensor 20 fixed onto the chassis 16 of the winder, which measures, without contact, the variation in height of the axis of the spool 8 and therefore of its diameter, so as to monitor the progressive rise of this axis and to control the braking force on the geared motor 48 as a consequence.

Another advantage of the device employed to regulate the tension of strip by a geared motor 48 controlled by motor torque or braking torque, is that in the event of an incident during the spooling of flat elements, it is possible to partially unwind the spool 6 in order to remove the defective elements. The freed strip 26 is then wound back onto the hub 60 by the geared motor, delivering a motor torque to extract the defective flat elements. Since the belt of the conveyor 12 has no motor drive of its own, it follows synchronously without causing any additional damage that might be caused by slipping on the flat elements, unspooling of the defective parts takes place cleanly, and this allows the winding to be restarted where the elements are good, thus reducing any losses.

The invention claimed is:

1. A winding machine that includes an assembly for the spooling of a continuous flow of flat and flexible elements aligned along a longitudinal axis and partially overlapping, to form a spool by rolling these elements in a spiral around a drum mounted onto a rotating axis supported by a chassis, with the insertion of a flexible central strip between the turns, and an assembly for unwinding said flexible strip, one end of which is fixed onto the drum and the other end of which unwinds from a hub fixed onto a shaft distinct from said rotation axis, on which hub the strip has previously been wound, with a braking device being provided on the hub to ensure continuous tension of the strip, wherein the machine also includes a motor-driven resource to regulate the transverse position of the hub so as to perform a lateral movement of this hub in relation to the spool in order to maintain a constant alignment of the strip during the winding process, the shaft being supported by a trolley mobile transversally and mounted on a guidance resource allowing a transverse movement in relation to a chassis of the unwinding assembly, wherein the braking device includes a rotating electrical machine controlled by a command to deliver a braking force or a motor torque to the hub, and wherein the rotating electrical machine is fixed to the trolley, so that the hub together with the rotating electrical machine are mobile transversally in respect to the drum.

2. A winding machine according to claim 1, wherein the motor-driven resource is an electrical actuator connected firstly to the chassis and secondly to the trolley, effecting a transverse positioning of one in relation to the other.

3. A winding machine according to claim 1, wherein the motor-driven resource to regulate the transverse position of the hub in relation to the spool, in order to control its movement during the winding process, uses a sensor that is fixed in relation to a chassis of the unwinding assembly, providing data on the lateral position of the strip in a location situated close to the unwinding point of the strip of the hub.

4. A winding machine according to claim 1, wherein the motor-driven resource to regulate the transverse position of the hub is used to align the strip laterally on the hub during a prior operation for winding the strip onto the hub from the drum.

5. A winding machine according to claim 4, wherein the lateral alignment of the strip in relation to the hub during the prior operation for winding onto this hub uses a sensor that is fixed in relation to the trolley, providing data on the lateral position of the strip in a location situated close to the winding point of the strip onto the hub.

6. A winding machine according to claim 3 or 5, wherein the sensor providing data on the lateral position of the strip is an optical sensor.

7. A winding machine according to claim 1, wherein the continuous flow of flat elements is fed by a belt of a conveyor, wherein the drive of the said belt is achieved by tangential contact of this belt onto the external periphery of the spool, and wherein a sensor gives an indication on the movement of the belt and on the direction of this movement, so as to control the electrical machine and apply either a braking force if the machine is in the process of winding, or a motor torque if the machine is rotating in the other direction to start a prior operation for winding the strip onto the hub.

8. A winding machine according to claim 1, wherein the traction on the strip created by the braking force delivered by the electrical machine falls off regularly during a winding operation.

9. A winding machine according to claim 8, wherein the decrease in the traction on the strip during a winding operation is monitored by a sensor providing data on the external diameter of the spool in the process of winding.

10. A winding machine according to claim 8, wherein the decrease in the traction on the strip between the start and the end of the winding process is on the order of one third of the starting traction value.

11. A winding machine according to claim 1, wherein the flat elements wound onto the spool are envelopes.

12. A winding machine according to claim 11, wherein the spooled envelopes have a width of about 19 to 24 centimeters and a height of about 11 to 18 centimeters, and in that the tension of the strip is of the order of 300 Newtons at the start of the winding and 100 Newtons at the end.

13. A process for the winding of a spool from a continuous stream of flat and flexible elements aligned along a longitudinal axis and partially overlapping, by rolling the said flat elements in a spiral around a drum with the insertion between the turns of a flexible central strip rolling off a hub, wherein the hub is driven by a rotating electrical machine, wherein during the unwinding process, the lateral position of the said flexible central strip wound around the said drum is continuously monitored, and wherein the transverse position of the said hub with the rotating electrical machine is modified according to the result of the said monitoring.

14. A winding process according to claim 13, wherein monitoring of the lateral position of the flexible central strip wound around the drum is effected by monitoring resources linked to a motor-driven resource to regulate the transverse position of the hub.

15. A process according to either of claims 13 and 14, wherein monitoring of the lateral position of the flexible central strip wound around the drum determines the offset between this said lateral position of the flexible central strip and the axis of the drum, and in that the transverse position of the hub is modified in order to remove this said offset.

16. A process according to claim 13, wherein prior to the winding of the flat elements in a spiral around the drum, with insertion of the flexible central strip between the turns, the said flexible central strip is drawn from a drum and wound around the hub.

17. A process according to claim 16, wherein, during the winding of the flexible central strip around the hub, the lateral position of the said flexible central strip wound around the said hub is monitored continuously, and in that the transverse position of the said hub is modified according to the result of the said monitoring.

18. A process according to claim 17, wherein monitoring of the lateral position of the flexible central strip wound around the hub is effected by monitoring resources that are linked to a motor-driven resource so as to regulate the transverse position of the hub.

19. A process according to either of claims 17 and 18, wherein monitoring of the lateral position of the flexible central strip wound around the hub determines the offset between this said lateral position of the flexible central strip and the axis of the said hub, and in that the transverse position of the said hub is modified in order to remove this said offset.

20. A process according to claim 13 wherein, during the winding of the flat elements in a spiral around the drum, the tension of the flexible central strip is adjusted continuously on the formation of each turn.

21. A process according to claim 20, wherein the adjustment of the tension of the flexible central strip is achieved by adjusting the unwinding speed of this said flexible central strip from the hub.

22. A process according to claim 21, wherein the unwinding speed of the flexible central strip from the hub reduces as the diameter of the spool increases.

23. A process according to claim 22, wherein the decrease of the unwinding speed of the flexible central strip from the hub is achieved by means of a braking device provided on the said hub and linked to a monitoring resource at the axis of the spool.

24. A process according to claim 13, wherein the rotating electrical machine delivers a braking force or a torque to the hub.

* * * * *